US009752726B2

(12) United States Patent
Frenal et al.

(10) Patent No.: US 9,752,726 B2
(45) Date of Patent: Sep. 5, 2017

(54) GAS SUPPLY DEVICE

(71) Applicant: L'Air Liquide, Société Anonyme pour l'Etude et l'Exploitation des Procédés Georges Claude, Paris (FR)

(72) Inventors: Antoine Frenal, Ezanville (FR); Denis Muller, Rueil Malmaison (FR)

(73) Assignee: L'Air Liquide, Société Anonyme pour l'Etude et l'Exploitation des Procédés Georges Claude, Paris (FR)

( * ) Notice: Subject to any disclaimer, the term of this patent is extended or adjusted under 35 U.S.C. 154(b) by 0 days.

(21) Appl. No.: 14/695,209

(22) Filed: Apr. 24, 2015

(65) Prior Publication Data

US 2015/0308620 A1 Oct. 29, 2015

(30) Foreign Application Priority Data

Apr. 24, 2014 (FR) ..... 14 53672

(51) Int. Cl.
*F17C 1/02* (2006.01)
*F17C 13/08* (2006.01)
*F17C 5/00* (2006.01)

(52) U.S. Cl.
CPC ..... *F17C 1/02* (2013.01); *F17C 5/00* (2013.01); *F17C 13/08* (2013.01); *F17C 13/084* (2013.01);
(Continued)

(58) Field of Classification Search
CPC ..... F17C 1/02; F17C 13/08; F17C 13/084; F17C 5/00; F17C 2205/0188;
(Continued)

(56) References Cited

U.S. PATENT DOCUMENTS 3,602,368 A * 8/1971 Gould ..... F17C 13/084 108/55.1
4,295,431 A * 10/1981 Stavlo ..... B65D 19/08 108/55.1
(Continued)

FOREIGN PATENT DOCUMENTS

DE 3026495 A1 * 1/1982 ..... B65D 19/38
DE 82 29 199 U1 12/1982
(Continued)

OTHER PUBLICATIONS

French Search Report and Written Opinion for corresponding FR 1453672, Dec. 8, 2014.

*Primary Examiner* — Stanton L Krycinski
(74) *Attorney, Agent, or Firm* — Elwood L. Haynes

(57) ABSTRACT

Gas supply device comprising a frame (2) housing a set of pressurized-fluid cylinders (3) linked to a fluid circuit (4, 5) for filling and emptying the cylinders (3), the support frame (2) comprising a lower base (34) on which the cylinders (3) rest vertically and a set of uprights (30) and cross beams (31, 32, 33) forming a cage with an overall parallelepiped shape to provide lateral support for the cylinders (3) arranged in several contiguous rows, characterized in that it includes at least one rigid reinforcement bar (6) for the frame (2) arranged between two rows of contiguous cylinders (3), said at least one reinforcement bar (6) resting simultaneously on the upper surface of the cylinders (3) in two rows of adjacent cylinders (3), the reinforcement bar (6) having two extremities connected rigidly and respectively to two opposing faces of the frame (2).

2 Claims, 2 Drawing Sheets

(52) U.S. Cl.
CPC ..... *F17C 2201/0109* (2013.01); *F17C 2201/0119* (2013.01); *F17C 2201/032* (2013.01); *F17C 2201/056* (2013.01); *F17C 2205/0107* (2013.01); *F17C 2205/0142* (2013.01); *F17C 2205/0188* (2013.01); *F17C 2205/0192* (2013.01); *F17C 2223/0123* (2013.01); *F17C 2223/035* (2013.01); *F17C 2223/036* (2013.01); *F17C 2250/043* (2013.01); *F17C 2260/015* (2013.01); *F17C 2260/036* (2013.01); *F17C 2270/0745* (2013.01)

(58) Field of Classification Search
CPC ..... F17C 2205/0192; F17C 2205/0142; F17C 2205/0107; F17C 2201/0109; F17C 2201/0119; F17C 2201/032; F17C 2201/056; F17C 2270/0745; F17C 2260/036; F17C 2260/015; F17C 2223/0123; F17C 2223/035; F17C 2223/036; F17C 2250/043
See application file for complete search history.

(56) References Cited

U.S. PATENT DOCUMENTS 4,481,972 A * 11/1984 Stavlo ..... B65D 19/08 108/55.1
4,564,109 A * 1/1986 Stavlo ..... B65D 19/08 206/391
5,152,594 A * 10/1992 Ashley ..... A47B 55/00 312/270.1
5,176,265 A 1/1993 Bennett
5,292,012 A * 3/1994 Davis ..... B60P 3/2205 211/85.18
6,059,127 A * 5/2000 Bennett ..... B62B 3/02 211/85.18
6,196,255 B1 * 3/2001 Poillucci ..... F17C 13/084 137/255
7,017,741 B1 * 3/2006 Williamson ..... F17C 13/084 206/386
7,070,372 B2 * 7/2006 Denike ..... F17C 13/084 211/85.18
7,275,902 B1 10/2007 Klotz
7,707,795 B2 * 5/2010 Yu ..... E04B 2/7422 403/402
7,997,213 B1 * 8/2011 Gauthier ..... B65D 88/022 108/53.1
8,016,300 B2 * 9/2011 Cramer ..... B62B 5/049 137/899.3
2014/0290797 A1 * 10/2014 Kriese ..... F17C 13/084 141/99

FOREIGN PATENT DOCUMENTS

DE 3234753 A1 * 3/1984 ..... B65D 19/10
DE 38 05 497 4/1989
DE 3805497 C1 * 4/1989 ..... F17C 13/084
DE 201 03 682 U1 5/2001
DE 10 2011 014065 9/2012
FR 2510973 A2 * 2/1983 ..... B65B 27/04
FR EP 1621808 A2 * 2/2006 ..... B65D 88/12
GB 2 007 348 5/1979

* cited by examiner

GAS SUPPLY DEVICE

CROSS REFERENCE TO RELATED APPLICATIONS

This application claims the benefit of priority under 35 U.S.C. §119 (a) and (b) to French Patent Application No. 1453672 filed Apr. 24, 2014, the entire contents of which are incorporated herein by reference.

BACKGROUND

The present invention relates to a gas supply device.

The invention relates more specifically to a gas supply device comprising a frame housing a set of pressurized-fluid cylinders linked to a fluid circuit for filling and emptying the cylinders, the support frame comprising a lower base on which the cylinders rest vertically and a set of uprights and cross beams forming a cage with an overall parallelepiped shape to provide lateral support for the cylinders arranged in several contiguous rows.

The invention relates specifically to gas supply devices sometimes referred to as "frames".

Such a device is described for example in documents DE20103682U1, GB2007348 A1 and DE102011014065 A1.

Such devices usually use a group of cylinders storing gas at high pressure, for example 200 or 300 bar or above.

These devices are subject to various, often conflicting constraints, for example: a structure that is ergonomic and as small as possible, while still providing adequate protection for the cylinders against impact. The structure must in particular be able to carry the weight of the set of cylinders when lifting by sling or crane. During such lifting operations, the frame is subject to tensile stress generated between the upper anchoring points (lifting eyes on top four corners or central eye) and the base of the frame on which the cylinders rest.

Consequently, the structure of these frames has to be relatively rigid.

This rigidity of the frame requires the cylinders and the frame chassis to be relatively robust in order to absorb the energy transmitted by the frame if the unit is dropped. Indeed, certain parts of the device breaking may result in relatively serious accidents.

SUMMARY

One objective of the present invention is to mitigate some or all of the drawbacks of the prior art as set out above, and in particular to propose a device with good impact strength.

For this purpose, the device according to the invention, in addition to conforming to the generic definition given in the preamble above, is essentially characterized in that it includes at least one rigid reinforcement bar for the frame arranged between two rows of contiguous cylinders, said at least one reinforcement bar resting simultaneously on the upper surface of the cylinders in two rows of adjacent cylinders, the reinforcement bar having two extremities connected rigidly and respectively to two opposing faces of the frame.

Furthermore, the embodiments of the invention may have one or more of the following features:

- the at least one reinforcement bar rests against the cylinders and generates a vertical force on the cylinders oriented towards the base,

- the two extremities of the reinforcement bar are connected rigidly and respectively to two cross beams of the frame located respectively on two opposing faces of the frame,
- the extremities of the at least one reinforcement bar are connected rigidly to the cross beams via at least one connecting pin such as a stud arranged in a vertical plane parallel to the plane of a lateral face of the frame,
- the connecting pin or pins include a mechanism such as a screw/thread system for adjusting the vertical position of the bar in relation to the cross beam to which it is connected to adjust the vertical bearing force of the bar on the cylinders,
- the device includes intermediate corner reinforcing members arranged respectively at the joins between the extremities of the cross beams connected to the at least one reinforcement bar on the one hand, and the related adjacent uprights on the other, the intermediate corner reinforcing members being rigid and having two extremities connected rigidly and respectively to a cross beam and to the adjacent upright,
- the cross beams connected to the at least one reinforcement bar are located in the upper half of the frame and preferably in the upper third of the frame,
- the upper extremity of the cylinders has a convex ogive shape and the at least one reinforcement bar rests on the convex portion of the cylinders,
- the cylinders located on the outside of the group of cylinders bear laterally against the uprights and/or cross beams of the frame,
- the device includes upper corner reinforcing members arranged respectively at the joins between the extremities of the cross beams delimiting the upper extremity of the frame on the one hand, and the related adjacent uprights on the other, the upper reinforcing members being rigid and having two extremities connected rigidly and respectively to a cross beam and to the adjacent upright,
- the device includes at least three rows of at least three cylinders seated in the frame and two parallel reinforcement bars resting simultaneously on the upper surface of two rows of adjacent cylinders,
- the device includes four rows of four cylinders seated in the frame and two parallel reinforcement bars resting simultaneously on the upper surface of two separate pairs of rows of adjacent cylinders,
- the device has a face delimited by uprights having a vertical length that is less than the length of the vertical uprights of the opposing face, i.e. one face of the frame is higher than the opposite face,
- the at least one reinforcement bar is parallel to said faces of the frame of different heights,
- the frame has upper cross beams located at the upper extremity of the frame and respectively connecting the uprights two-by-two,
- the upper cross beams connecting the uprights of different heights are inclined and/or curved,
- the frame includes a central post, the lower extremity of which is rigidly connected to the central portion of the base and the upper extremity of which has a frame hoisting ring projecting beyond the parallelepiped volume of the cage,
- at least one portion of at least one of the faces of the frame (side or upper faces) has a grille and/or a solid partition, the frame has intermediate and lower cross beams located respectively halfway up and in the lower portion of the frame and respectively connecting the uprights two-by-two.

The invention may also relate to any alternative device or method including any combination of the features set out above or below.

BRIEF DESCRIPTION OF THE DRAWINGS

Other characteristics and advantages are set out in the description below, provided with reference to the figures in which.

DESCRIPTION OF PREFERRED EMBODIMENTS

Figure 1:
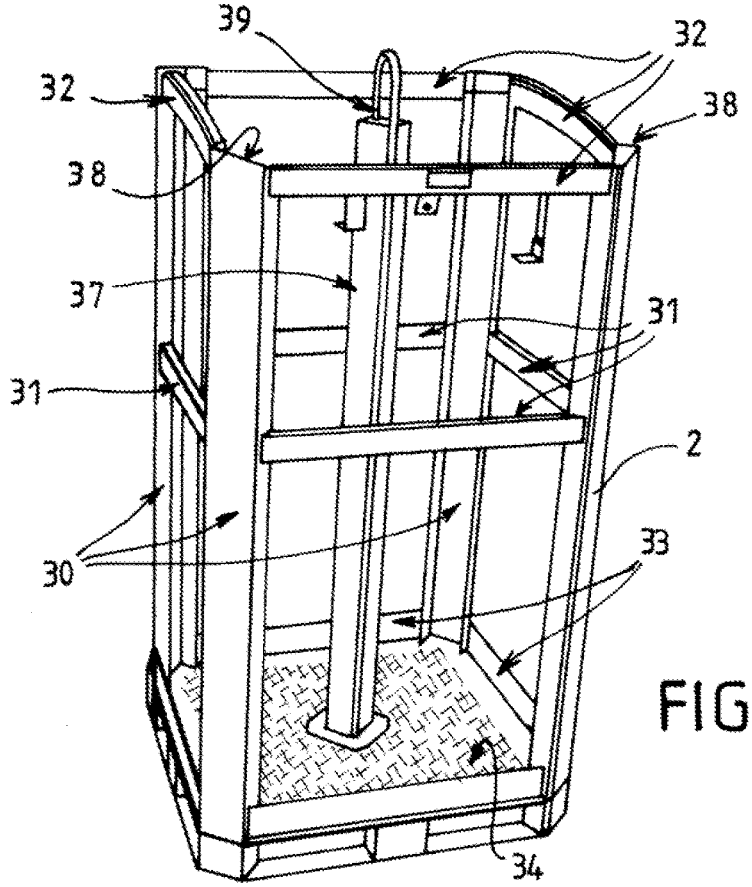
FIG. 1 is a partial schematic perspective view showing a possible exemplary embodiment of a portion of the frame in a partially disassembled configuration (with no cylinders or reinforcement bars)
Figure 2:
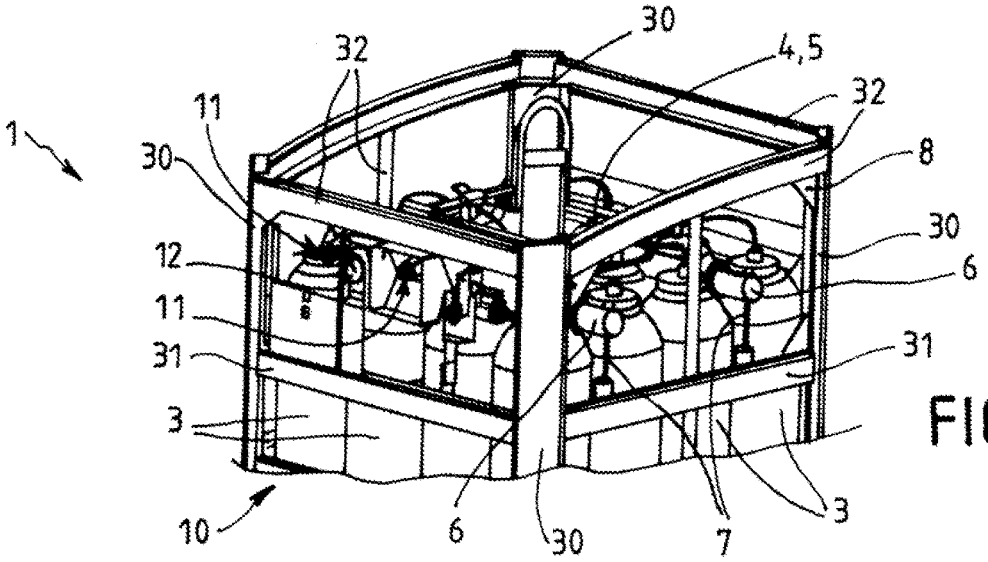
FIG. 2 is a partial schematic perspective view of a detail of the upper portion of the device in FIG. 1 when ready for use.
Figure 3:
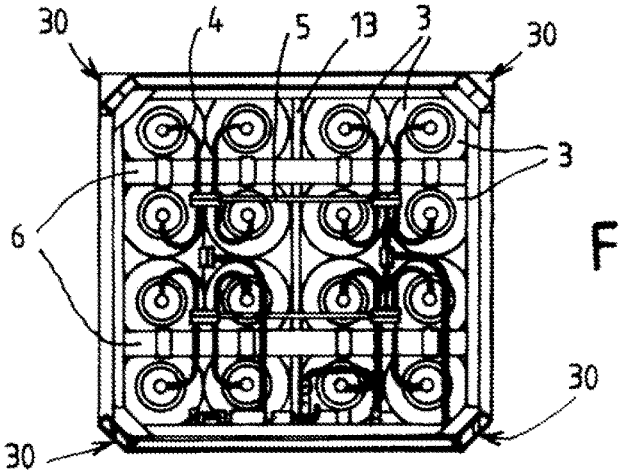
FIG. 3 is a top view of the device in FIG. 2.
Figure 4:
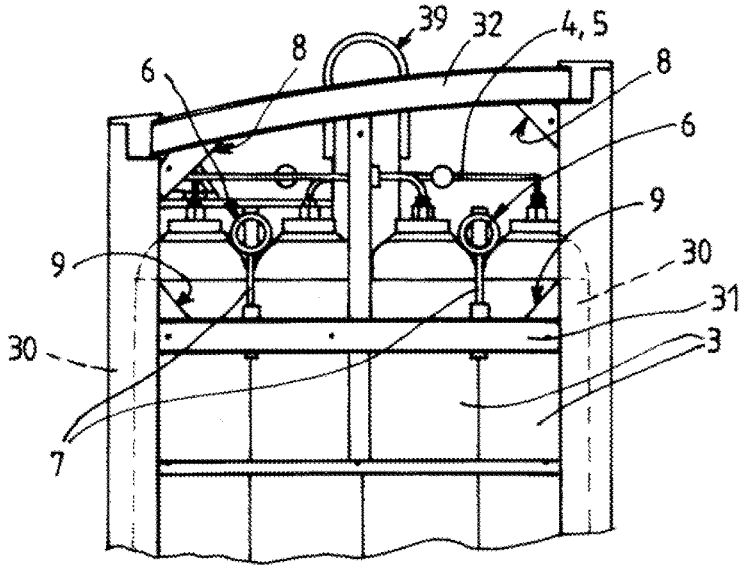
FIG. 4 is a side view of the upper portion of the device in FIG. 2.

The gas supply device 1 illustrated partially in FIG. 1 and in FIGS. 2 to 4 conventionally comprises a supporting frame 2, comprising for example a metal structure with an overall parallelepiped shape housing a plurality of pressurized-fluid cylinders 3.

For example, the cylinders 3 are arranged vertically in a group on a base 34. The cylinders 3 are arranged in several rows of adjacent cylinders (four rows of four cylinders 3 in the non-limiting example shown in the figures).

The upper portion of each cylinder 3 has an orifice connected to a fluid circuit 4, 5 used to fill or empty the cylinders 3.

For example, the circuit 4, 5 has a first connection extremity connected to the cylinders 3 via a first isolating valve to enable the cylinders 3 to be filled and emptied. The circuit may include a separate, second connection extremity connected to the orifices of the cylinders 3 via a second isolating valve and a relief valve.

The frame 2 includes a set of four vertical uprights 30, the lower extremities of which are connected respectively to the four corners of the square (or parallelepiped) base 34.

The vertical uprights 30 may have a parallelepiped or U-shaped section and may be oriented to form a flat surface at the vertical edges of the frame 2, i.e. the face of the uprights 30 facing the cylinders 3 is oriented to approximately 45° in relation to the sides of the parallelepiped base 34, i.e. one of the wider sides of the parallelepiped section of the upright 30 is oriented towards the centre of the frame 2.

The frame 2 also includes horizontal cross beams 31, 32, 33 delimiting the lateral faces of a cage having an overall parallelepiped shape for keeping the cylinders 3 vertical (see FIG. 2 or 3).

In particular, the frame 2 may include four lower cross beams 33, four intermediate cross beams 31 and four upper cross beams 32.

As shown in FIG. 3, where applicable, two pairs of rows of four cylinders 3 may be separated by a partition or by one or more cross beams 13 located inside the frame 2. Any cylinders adjacent to this separation 13 are preferably in contact with same.

The frame 2 may include a central post 37, the lower extremity of which is rigidly connected to the central portion of the base 34 and the upper extremity of which has a frame hoisting ring 39 projecting beyond the parallelepiped volume of the cage.

At least one portion of at least one of the faces of the frame (lateral or upper faces) may be at least partially fitted with a grille and/or a solid partition attached to the uprights 30 and the cross beams 31, 32, 33.

The frame 2 may include, on one of the lateral faces of same referred to as the "front face", an interface panel having at least one opening and in particular at least one access to the circuit 4, 5 and in particular to the members of the circuit (fluid connection(s) 11, pressure gauge 12).

According to an advantageous characteristic, the device includes at least one, and in this example two, rigid bars 6 for reinforcing the frame 2. The reinforcement bars 6 are arranged between two rows of adjacent cylinders 3. Each reinforcement bar 6 rests simultaneously on the upper surface of the cylinders 3 of two rows of adjacent cylinders 3. Each reinforcement bar 6 has two extremities connected rigidly and respectively to two cross beams 31 of the frame located respectively on two opposing faces of the frame 2. Naturally, alternatively or cumulatively, the reinforcement bars 6 may be connected rigidly to the base 34 of the frame, to a lower cross beam of the frame, and to an upper cross beam 32 of the frame.

Preferably, the upper extremity of the cylinders 3 has a convex ogive shape and the reinforcement bars 6 rest on the convex portion of the cylinders 3.

As illustrated, the bars 6 may be tubular and for example have a circular section. The bars may be made of steel or any other appropriate material (preferably the same material as that used for the frame).

Since they rest on two rows of adjacent cylinders and/or above the cylinders, the reinforcement bars 6 generate a force holding the cylinders 3 with a vertical component (towards the base 34) and a transverse component (helping to press the peripheral cylinders 3 against the lateral faces of the frame 2). The reinforcement bars 6 may be positioned bearing against the cylinders 3 to generate a vertical force on the cylinders 3 towards the base.

This helps to hold the cylinders 3 against the sheet of the base 34 and against the uprights 30 or cross beams 31, 32, 33. Furthermore, this distributes the forces within the frame, which helps to dissipate some of the energy generated by an impact, thereby at least partially protecting the cylinders 3. Indeed, this structure defines two portions within the frame 2: a first portion located between the cross beams 31 connected to the reinforcement bars 6 and the base 34 and a second portion located between the cross beams 31 connected to the reinforcement bars 6 and the upper extremity of the frame 2.

The first portion is relatively more rigid and non-deformable on account of the cohesion between the cylinders 3 held against the frame 2 by the reinforcement bars 6.

Figure 5:
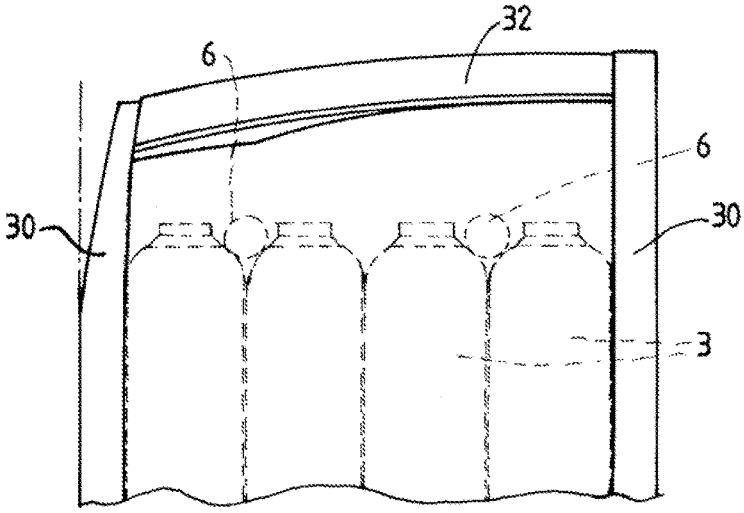
FIG. 5 is a partial schematic side view of the upper portion of the device in FIG. 2 after it has been deformed by an impact.

The second portion, which does not bear against the cylinders 3 (portion located above the cylinders 3), is relatively less rigid and more deformable in the event of impact. Specifically, if the frame 2 falls onto the vertical extremity of same, the second portion can absorb the energy by deforming. The vertical uprights 30 can in particular form zones that deform by bending above the cross beams 31 connected to the reinforcement bars 6 (see for example FIG. 5) while some of the force is transmitted to the lower, more rigid portion via the bars 6, the cylinders, etc.

This architecture helps to absorb and distribute forces advantageously in comparison to known structures.

This in particular facilitates a natural deformation towards the inside of the frame 2 to complement the general deformation of the chassis.

This enables bending of the uprights 30 and of the gas circuit, thereby limiting the risk of folding/tearing if the valves in the circuit 4, 5 are moved. The fluid circuit 4, 5 is advantageously housed in the deformable portion of the frame 2 and can therefore be designed preferably to deform in the event of contact with the frame 2 following significant deformation or in the event of movement of the cylinders 3 in the event of breakage of the attachments of same to the frame 2.

For this purpose, the circuit may include a shared collector portion comprising a closed loop 5 (that is relatively more rigid) and a relatively more flexible portion comprising pipes 4 that are more flexible and that link the cylinders 3 to the closed loop 5.

As illustrated, the extremities of the reinforcement bars 6 may be connected rigidly to the cross beams 31 via at least one connecting pin 7 such as a stud arranged in a vertical plane parallel to the plane of a lateral face of the frame 2.

Thus, the connecting pins 7 may include a mechanism such as a screw/thread system (with nut, where applicable). Preferably, this mechanism enables the vertical position of the bar 6 to be adjusted in relation to the cross beam 31 to which it is connected, to adjust the vertical bearing force of the bar 6 on the cylinders.

The intermediate cross beams 31 to which the reinforcement bars 6 are connected may be positioned halfway up the frame 2 and preferably approximately two-thirds or three-quarters of the way up the frame 2.

As illustrated, the frame 2 may also include intermediate corner reinforcing members 9 arranged respectively at the joins between the extremities of the cross beams 31 connected to the reinforcement bars 6 on the one hand, and the related adjacent uprights 30 on the other.

The intermediate corner reinforcing members 9 are rigid and have two extremities connected rigidly (welded, riveted or other) and respectively to a cross beam 31 and to the adjacent upright 30.

Equally, the frame 2 may include upper corner reinforcing members 8 arranged respectively at the joins between the extremities of the cross beams 32 delimiting the upper extremity of the frame 2 on the one hand, and the related adjacent uprights 30 on the other. As above, these upper corner reinforcing members 8 are rigid and include two extremities connected rigidly and respectively to a cross beam 32 and to the adjacent upright 30. The corner reinforcing members 8, 9 may for example be square-shaped.

The structure according to the invention therefore enables a set of cylinders to be clamped and held (vertically and laterally) in a frame 2.

The structure thus forms a direct force transmission chain between the frame 2 and the cylindrical portion of the cylinders 3.

The upper extremities of the four uprights 30 located above the reinforcement bars 6 form four preferred bending/folding/twisting zones that are able to dissipate energy if the frame 2 falls.

These bending zones may in particular be delimited by the position and dimension (including thickness) of the corner reinforcing members 8, 9 connecting the uprights 30 and the cross beams 31, 32.

The deformation of this portion is a function of the energy generated by the impact when the frame 2 falls, the intrinsic rigidity of the deformation zone of the frame 2 (thickness and shape of the uprights 30, of the beams 31, 32 and of the corner reinforcing members 8, 9).

The maximum amplitude of the deformation may be calculated such that the deformation zone never covers the sensitive, pressurized members of the circuit 4, 5. Furthermore, it may be formed to guarantee that the attachment system (reinforcement bar 6 and connecting pin 7) are not adversely affected by the deformation of the uprights 30 in order to guarantee maximum cohesion of the cylinders 3 in the frame 2.

For this purpose, as described above, the vertical uprights 30 are preferably positioned at 45° in relation to the plane of the lateral faces of the frame 2.

Several degrees of deformation may occur as a function of the potential energy stored when the frame 2 falls. The potential energy of the impact depends in particular on the mass of the frame 2 (and therefore the quantity of gas carried, the mass of the overall structure being constant), the falling speed of the frame and the intrinsic damping of the ground onto which the frame falls.

Different possible degrees of deformation are detailed below in the event of impact on an upper corner of the frame 2. These anticipated deformations are listed by increasing order of the energy of the impact.

- partial crushing of the external face of the tubular profile of the vertical upright 30,
- total crushing of the tubular profile of the upright 30,
- twisting of the upright 30 (until the face of same is parallel, where applicable, with a face of the frame 2),
- bending of the upright 30 limited by the presence of the corner reinforcing members 8, 9 enabling a more uniform distribution of the stresses throughout the structure, Naturally, this order is given by way of example and the order and the amplitude of the degrees of deformation may be changed as a function of conditions.

The presence of curved lateral cross members (beams) 32 on the upper portion of the frame 2 can enable the bending of the vertical upright 30 impacted by the fall to be followed without transmitting excessive stress to the opposite upright 30.

As illustrated, the "rear" lateral face of the frame 2 may be delimited by uprights 30 with a length (height) greater than the length (height) of the uprights 30 of the opposite, "front" face 35.

The upper cross beams 32 connecting an upright 30 on the rear face to an upright 30 may therefore be straight and inclined towards the bottom of the back towards the front and/or be curved with the concavity oriented towards the base 34.

The upper geometry of the frame 2 helps to improve the impact strength of the frame as described above without excessively increasing the mass, cost or complexity of the frame 2.

Indeed, according to the invention, the deformation and impact strength of the frames is improved in relation to the prior art without having to provide impact absorption or protection members on the periphery of the frame.

This partially deformable structure enables the frame itself to absorb part of the energy of the impact. This enables only a part of the deceleration of the frame to be transmitted to the cylinders and the attachments of same.

This helps to protect the gas circuit 4, 5 of the frame by preventing excessive deformation of this latter through the relative movement of the cylinders 3 in relation to one another.

This helps to significantly limit the risk of a high-pressure gas leak.

The resulting deformation of the frame 2 also prevents the frame 2 from impacting against the pressurized-gas control members (valves, relief valves, etc.), thereby preserving the integrity of the high-pressure gas circuit.

Consequently, despite being a simple and cheap structure, the device has numerous advantages over known systems.

Naturally, other modifications are possible. Thus, the number and orientation of the reinforcement bars 6 may be modified. For example, the reinforcement bars may be arranged perpendicular to the front face of the frame 2.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

The invention claimed is:

1. A gas supply device comprising a frame housing a set of pressurized-fluid cylinders linked to a fluid circuit for filling and emptying the cylinders, the frame comprising a lower base on which the cylinders rest vertically and a set of uprights and cross beams forming a cage with an overall parallelepiped shape to provide lateral support for the cylinders arranged in several contiguous rows, the device including at least one rigid reinforcement bar for the frame arranged between two rows of contiguous cylinders, said at least one reinforcement bar resting simultaneously on the upper surface of the cylinders in two rows of adjacent cylinders, the reinforcement bar having two extremities connected rigidly and respectively to two opposing faces of the frame, wherein the at least one reinforcement bar rests against the cylinders to generate a vertical force on the cylinders oriented towards the base, the two extremities of the reinforcement bar being connected rigidly and respectively to the base and/or to two cross beams of the frame located respectively on two opposing faces of the frame, and in that the device includes upper corner reinforcing members arranged respectively at the joins between the extremities of the cross beams delimiting the upper extremity of the frame on the one hand, and the related adjacent uprights on the other, the upper reinforcing corner members being rigid and having two extremities connected rigidly and respectively to a cross beam and to the adjacent upright, further comprising a face delimited by said uprights having a vertical length that is less than the length of the vertical uprights of an opposing face, such that the face delimited by the uprights is higher than the opposite face.

2. The device of claim 1, wherein the at least one reinforcement bar is parallel to said faces of the frame of different heights.

* * * * *